US012163318B2

(12) United States Patent
Roediger et al.

(10) Patent No.: US 12,163,318 B2
(45) Date of Patent: Dec. 10, 2024

(54) SINK MOUNTING ASSEMBLY AND METHOD FOR ASSEMBLING A SINK MOUNTING ASSEMBLY

(71) Applicant: GROHE AG, Hemer (DE)

(72) Inventors: Sascha Roediger, Schwerte (DE); Stephan Venus, Menden (DE); Hendrik Begerow, Hemer (DE); Paul Ruebesamen, Meschede (DE); Pei Guo, Menden (DE); Bertrand Tchana Tchuinou, Hagen (DE); Horst Bachmann, Bochum (DE)

(73) Assignee: GROHE AG, Hemer (DE)

( * ) Notice: Subject to any disclaimer, the term of this patent is extended or adjusted under 35 U.S.C. 154(b) by 436 days.

(21) Appl. No.: 17/609,631

(22) PCT Filed: Mar. 26, 2020

(86) PCT No.: PCT/EP2020/058537
§ 371 (c)(1),
(2) Date: Nov. 8, 2021

(87) PCT Pub. No.: WO2020/224867
PCT Pub. Date: Nov. 12, 2020

(65) Prior Publication Data

US 2022/0220713 A1 Jul. 14, 2022

(30) Foreign Application Priority Data

May 7, 2019 (DE) ..... 102019003194.6

(51) Int. Cl.
*E03C 1/02* (2006.01)
*E03C 1/14* (2006.01)
(Continued)

(52) U.S. Cl.
CPC ..... *E03C 1/021* (2013.01); *E03C 1/14* (2013.01); *E03C 1/18* (2013.01); *E03C 1/22* (2013.01);
(Continued)

(58) Field of Classification Search
CPC .... A47K 1/04–05; A47K 2201/00–025; E03C 1/04; E03C 1/0403; E03C 1/042;
(Continued)

(56) References Cited

U.S. PATENT DOCUMENTS 3,170,667 A * 2/1965 Szohatzky ..... F16L 37/407 285/914
5,205,002 A * 4/1993 Sage-Passant ..... E03C 1/122 4/643
(Continued)

FOREIGN PATENT DOCUMENTS

EP 0664362 * 7/1995 ..... E03C 1/12
EP 0 916 773 5/1999
(Continued)

OTHER PUBLICATIONS

International Search Report dated Jun. 9, 2020 in International (PCT) Application No. PCT/EP2020/058537.

*Primary Examiner* — David P Angwin
*Assistant Examiner* — Nicholas A Ros
(74) *Attorney, Agent, or Firm* — WENDEROTH, LIND & PONACK, L.L.P.

(57) ABSTRACT

A washbasin installation arrangement (1), at least comprising a washbasin (2), a first functional unit (3) and a second functional unit (4), wherein the first functional unit (3) can be arranged on a wall element (5) and the second functional unit is connected to the washbasin (2), and wherein the functional units can be used to attach the washbasin (2) to
(Continued)

the wall element (5). Further disclosed is also a method of assembling a washbasin installation arrangement (1).

9 Claims, 5 Drawing Sheets

(51) Int. Cl.
*E03C 1/18* (2006.01)
*E03C 1/22* (2006.01)
*E03C 1/322* (2006.01)

(52) U.S. Cl.
CPC ..... *E03C 1/322* (2013.01); *E03C 2001/028* (2013.01)

(58) Field of Classification Search
CPC ..... E03C 1/12; E03C 1/14–18; E03C 1/322; E03C 1/324; E03D 11/14–146
See application file for complete search history.

(56) References Cited

U.S. PATENT DOCUMENTS

| | | | | | |
|---|---|---|---|---|---|
| 5,404,599 | A * | 4/1995 | Warkus | E04C 2/521 | 4/252.2 |
| 6,122,777 | A * | 9/2000 | Sage-Passant | E03C 1/021 | 4/695 |
| 7,204,267 | B1 * | 4/2007 | Persico | E03C 1/12 | 137/357 |
| 9,546,473 | B2 * | 1/2017 | Cronje | E03C 1/021 | |
| 10,233,620 | B2 * | 3/2019 | Wegelin | E03C 1/057 | |
| 2009/0211019 | A1 * | 8/2009 | Schluttig | E03C 1/126 | 4/584 |

FOREIGN PATENT DOCUMENTS

| | | | | |
|---|---|---|---|---|
| EP | 2310580 | * | 9/2015 | E03C 1/042 |
| GB | 2 423 560 | | 8/2006 | |
| WO | 2009/156492 | | 12/2009 | |

* cited by examiner

SINK MOUNTING ASSEMBLY AND METHOD FOR ASSEMBLING A SINK MOUNTING ASSEMBLY

CROSS-REFERENCE TO RELATED APPLICATIONS

This application is a U.S. national stage application filed under 35 U.S.C. § 371 of international application no. PCT/EP2020/058537 filed Mar. 26, 2020, which claims priority to German Patent Application No. 102019003194.6 filed May 7, 2019.

BACKGROUND OF THE INVENTION

The invention relates to a washbasin installation arrangement and a method of assembling a washbasin installation arrangement.

A sanitary connection faucet having a concealed faucet with a connection plate is known from DE 103 17 070 B3. To connect lines, plug connections are used to connect an installation plate to the connection plate. Hoses for connection to a faucet start at the installation plate.

DE 200 21 317 U1 describes a wall-mounted basin that can be slid onto a wall mounting and is then ready for use. On the basin, plug-in faucet connection, plug-in pipe connections, siphon pipe and siphon are provided individually and connected to the matching ports at the basin.

Some of these known arrangements are complex to manufacture or assemble.

The invention addresses the problem of at least partially solving the issues indicated with reference to the prior art. In particular, a simpler and/or quicker installation of a washbasin installation arrangement is proposed.

BRIEF SUMMARY OF THE INVENTION

A washbasin installation arrangement having the features recited herein and a method of assembling a washbasin installation arrangement having the features recited herein contribute to solving this problem. Advantageous further developments are provided herein. The features listed individually can be combined with one another in a technologically useful manner and can be supplemented by explanatory facts from the description and/or details from the figures, wherein further embodiment variants of the invention are identified.

A washbasin installation arrangement contributes to this purpose, at least comprising a washbasin, a first functional unit, and a second functional unit.

The first functional unit can be or is arranged on a wall element and has at least one first port for the fluidic connection to at least one supply line for a fluid (e.g., water), a first line extending through the first functional unit, and a first connecting element that is fluidically connected to the first port via the first line.

The second functional unit can be or is connected to the washbasin, wherein the second functional unit has at least one second port for a faucet (e.g. a water tap), a second line extending through the second functional unit, and a second connecting element which is fluidically connected to the second port via the second line.

The washbasin in conjunction with the second functional unit can be pushed onto the first functional unit attached to the wall element, wherein the first connecting element and the second connecting element form at least one fluidic connection of the second port and the supply line by sliding.

In particular, further ports, connecting elements and/or lines are provided such that, for instance, several different fluids can be routed through the functional units (e.g. cold and hot water).

The second functional unit may be detachably or inseparably connected to the washbasin. In particular, at least one screw or bolt connection can be used to connect the second functional unit to the washbasin.

Preferably, the second functional unit is inseparably connected to the washbasin. In particular, the washbasin is a ceramic component or a mineral composite component, wherein the second functional unit is pre-arranged in the washbasin or in the area of the washbasin during the manufacture of the mold of the washbasin (i.e., for instance, during casting). In particular, during the manufacture of the mold of the washbasin, a form fit has been manufactured between the second functional unit and the washbasin, i.e. the washbasin and the second functional unit cannot be separated from each other later without at least partially destroying one of the connecting partners.

In particular, the washbasin can be assembled from several individual components. For instance, at least one individual component of the washbasin can be manufactured in conjunction with a placeholder of the second functional unit (e.g., a copy with respect to the outer dimensions of the second functional unit), e.g. manufactured by casting. The second functional unit can then be inserted into the individual component at a later point in time, wherein the individual component is connected to a further individual component to form the washbasin. In particular, the second functional unit is at least undetachably arranged in or at the washbasin by the connection of the individual components, and is preferably also inseparably connected to the washbasin in the process.

In particular, the first functional unit and the second functional unit all include first and second lines connecting the at least one supply line to the faucet. In particular, the second lines are designed to be integrated into the second functional unit.

Preferably, the washbasin can be or is exclusively connected to the first functional unit via the second functional unit.

In particular, a fluid from the washbasin is drained via the second functional unit and the first functional unit.

Preferably, a siphon assigned to the drain is integrated in the first functional unit or in the second functional unit. Alternatively, the siphon is integrated in the washbasin (i.e. outside the first and second functional units).

In particular, a safety valve for closing and opening the line is arranged at least in the first line or in the second line. As a result of the separation of the functional units, the safety valve can be actuated (automatically), closing or sealing the line. As a result of connecting the functional units, the safety valve can be (automatically) actuated in such a way that the line becomes open or traversable for the fluid. Preferably, the safety valve is arranged in the first functional unit, i.e. between the first port and the first connecting element.

The safety valve can be used to isolate the functional units from each other, and in that way, isolate the washbasin from at least one supply line, without any fluid escaping.

Preferably, at least one of the functional units (preferably both) is an injection molded plastic part.

In particular, the functional units additionally have electrical signal lines that can be interconnected in an electrically conductive manner by sliding the second functional unit onto the first functional unit.

In particular, at least one of the functional units is designed as a pre-assembly unit. In particular, all components are functionally arranged (i.e., ready for operation) in the functional unit before the washbasin installation arrangement is assembled. Preferably, both functional units are designed in this way.

In particular, at least the connector and the connecting element of a functional unit are arranged to be immobile relative to each other (i.e., not movable relative to each other).

Preferably, the first functional unit can be slid onto fastening pins of the wall element, for instance, and connected thereto. A connection to the at least one supply line can be made, for instance, via a plug connection. At least the first port and the first connecting element remain unchanged with regard to their position and orientation.

The second functional unit can be connected to the washbasin, wherein at least the second connecting element and the second port have already been attached with respect to their position and orientation by the second connecting element even before the connection to the washbasin.

The second functional unit can be slid onto the first functional unit in particular (exclusively) along an axial direction. In particular, guides are provided on the first functional unit and/or the second functional unit, which guides interact with each other or each with the other functional unit to arrange the functional units.

In particular, the first functional unit has first coupling elements arranged in the first functional unit. The second functional unit has second coupling elements that interact with the first coupling elements to connect the functional units. In particular, the second coupling elements can be actuated by an actuating device (possibly the first coupling elements) or by exceeding a minimum pull-off force such that the connections between each first coupling element and second coupling element can be released and the second functional unit with the washbasin can be pulled off the first functional unit.

The washbasin installation arrangement permits an easy and quick assembly of the individual components. In particular, a washbasin can be arranged in a simple manner on a wall element at the installation site. In that way, fluid-tight connections between the at least one supply line and the faucet can be implemented using tightly toleranced connections. In particular, the functional units can be manufactured with tight tolerances to implement a fluid-tight connection via the connecting elements, which then also have tight tolerances to one another.

Further, a method for assembling the described washbasin assembly is proposed, at least comprising the steps listed below:

a) providing a wall element and at least one supply line;
b) providing a first functional unit;
c) connecting the first functional unit to the wall element and connecting the supply line c) to a first port of the first functional unit;
d) providing a washbasin having a second functional unit assigned thereto; and
e) sliding the second functional unit onto the first functional unit (and connecting the first port element and the second port element and forming at least one fluidic connection between the second port and the supply line as well as connecting the outlets of the functional units, if necessary).

In particular, the sliding is performed exclusively along an axial direction, wherein all fluidic and possibly electrical connections are preferably established between the functional units in so doing.

The explanation regarding the method can, in particular, be transferred to the washbasin installation arrangement and vice versa.

As a precaution, it should be noted that the numeral words used here ("first", "second", . . . ) are primarily used to (only) distinguish between several similar objects, quantities or processes, i.e., in particular, they do not necessarily specify a dependency and/or sequence of these objects, quantities or processes with respect to each other. If a dependency and/or sequence is required, this is explicitly stated here or it is obvious to the person skilled in the art when studying the specific embodiment described. Insofar as a component may occur more than once ("at least one"), the description for one of these components can apply equally to all or a part of the majority of these components, but that is not mandatory.

The invention and the technical environment are explained in more detail below with reference to the figures. It should be noted that the invention is not intended to be restricted by the cited exemplary embodiments. In particular, unless explicitly stated otherwise, it is also possible to extract partial aspects of the facts explained in the figures and combine them with other components and findings from this description. In particular, it should be noted that the figures and in particular the proportions shown are only schematic.

DETAILED DESCRIPTION OF THE INVENTION

Figure 1:
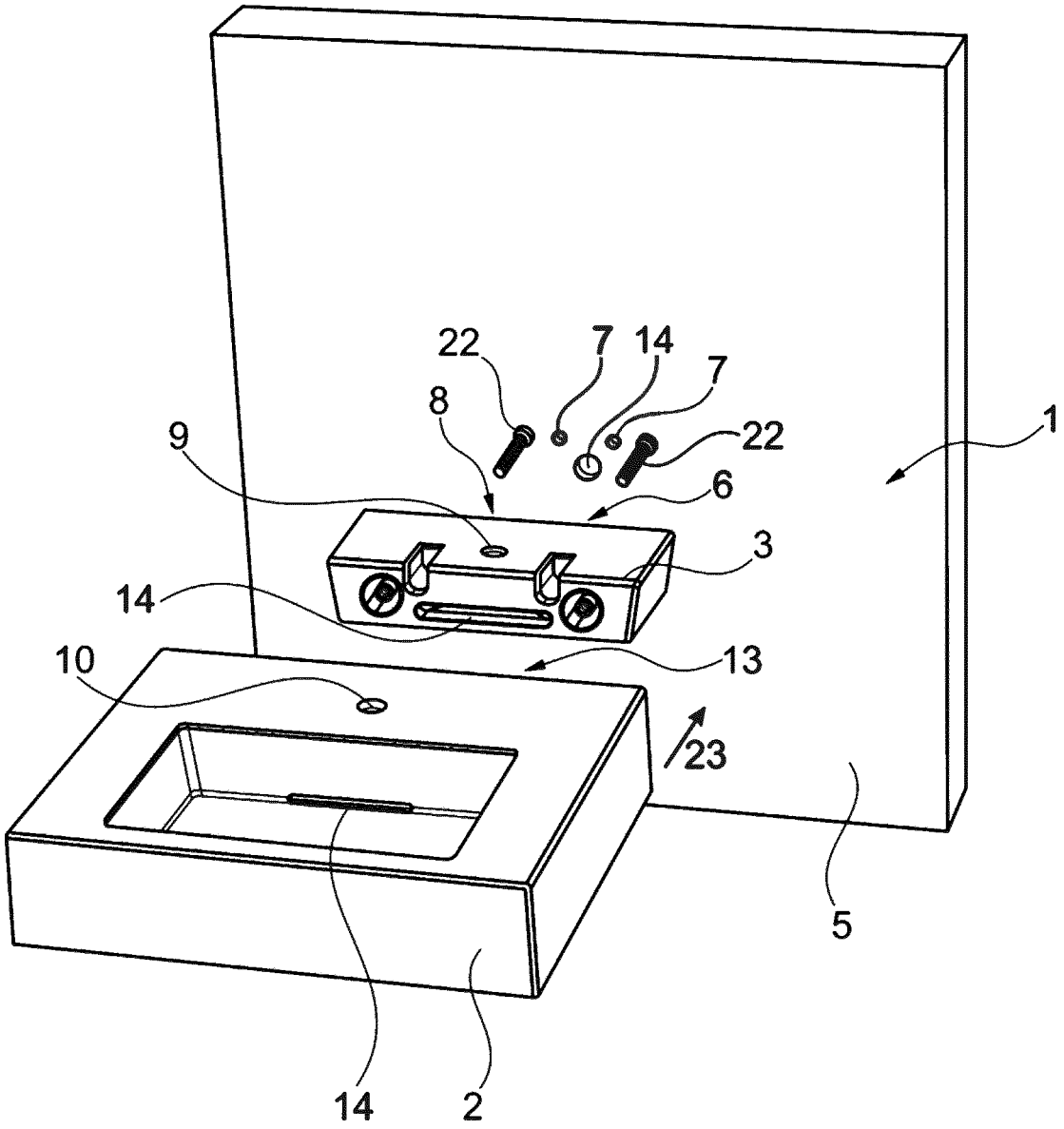
FIG. 1 shows step e) of the method.
Figure 2:
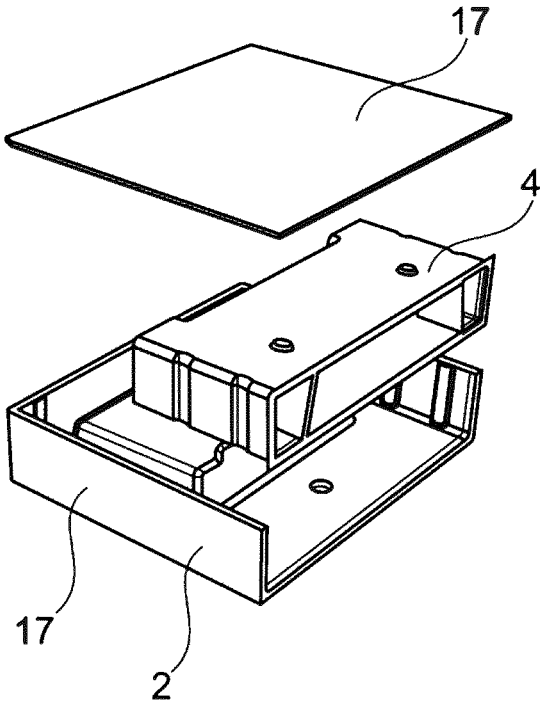
FIG. 2 shows an exploded and perspective view of a washbasin and a second functional unit from below.
Figure 3:
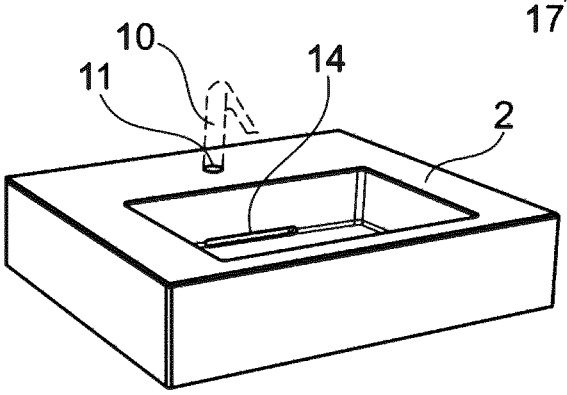
FIG. 3 shows an exploded view in a perspective view of the washbasin and the second functional unit from below during assembly.
Figure 5:
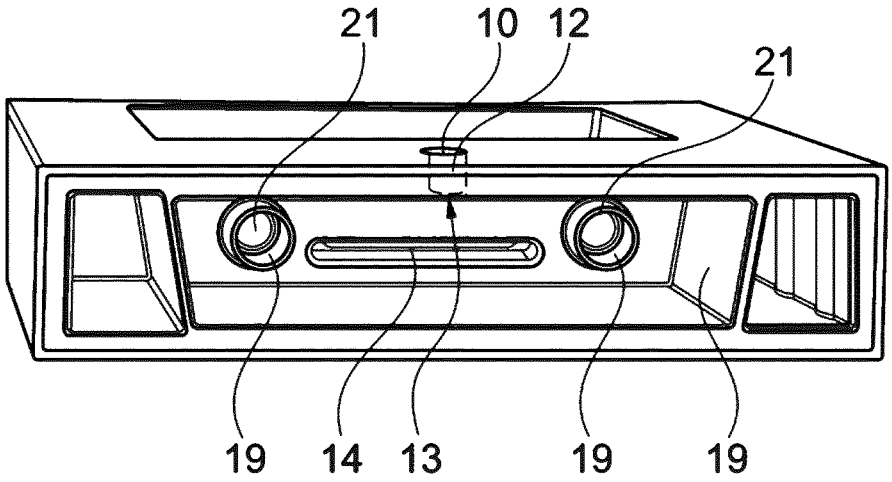
FIG. 5 shows a perspective view of the washbasin from behind with the second functional unit according to FIGS. 2 and 3.

FIG. 1 shows step e) of the method. The washbasin installation arrangement 1 comprises a washbasin 2, a first functional unit 3 (FIGS. 7 to 9) and a second functional unit 4 (FIGS. 2, 3 and 5). The first functional unit 3 is arranged on a wall element 5 and has a first port 6 for the fluidic connection to a supply line 7 for a fluid (e.g., water), a first line 8 extending through the first functional unit 3, and a first connecting element 9 that is fluidically connected to the first port 6 via the first line 8.

The second functional unit 4 is connected to the washbasin 2, wherein the second functional unit 4 has at least one second port 10 for a faucet 11 (e.g. a water tap), a second line 12 extending through the second functional unit 4, and a second connecting element 13, which is fluidically connected to the second port 9 via the second line 12.

The washbasin 2 in conjunction with the second functional unit 4 can be slid onto the first functional unit 3 attached to the wall element 5, wherein the first connecting element 9 and the second connecting element 13 are connected by sliding, in that way establishing a fluidic connection between the second port 10 and the supply line 7.

Figure 4:
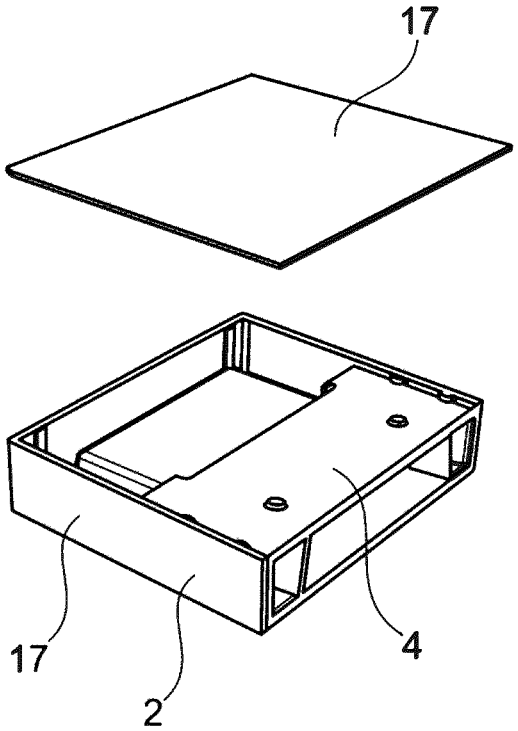
FIG. 4 shows a perspective view of the washbasin from above according to FIGS. 2 and 3.

FIG. 2 shows an exploded and perspective view of a washbasin 2 and a second functional unit 4 from below. FIG. 3 shows an exploded and perspective view of the washbasin 2 and the second functional unit 4 during assembly, from below. FIG. 4 shows a perspective view of the washbasin 2 according to FIGS. 2 and 3, from above. FIG. 5 shows a perspective view from behind of the washbasin 2 with the second functional unit according to FIGS. 2 to 3. FIGS. 2 and 5 are described jointly below.

The second functional unit 4 is connected to the washbasin 2, wherein the second functional unit 4 has at least one second port 10 for a faucet 11 (e.g. a water tap), a second line 12 extending through the second functional unit 4, and a second connecting element 13, which is fluidically connected to the second port 9 via the second line 12.

The washbasin 2 in conjunction with the second functional unit 4 can be slid onto the first functional unit 3 attached to the wall element 5 (FIG. 1), wherein the first connecting element 9 and the second connecting element 13 are connected by sliding, in that way establishing a fluidic connection between the second port 10 and the supply line 7.

The second functional unit 4 is inseparably connected to the washbasin 2. In this case the washbasin 2 is a ceramic component or a mineral composite component, wherein the second functional unit 4 has been arranged in the washbasin 2 during the manufacture of the shape of the washbasin 2. During the manufacture of the shape of the washbasin 2, a form fit has been manufactured between the second functional unit 4 and the washbasin 2, such that the washbasin 2 and the second functional unit 4 cannot be separated from each other without at least partially destroying one of the connecting partners. Here, the washbasin 2 is assembled from several individual components 17. For instance, at least one individual component 17 of the washbasin can be manufactured in conjunction with a placeholder of the second functional unit 4 (e.g., a copy with respect to the outer dimensions of the second functional unit 4), e.g., manufactured by casting. The second functional unit 4 can then be inserted into the individual component 17 (see FIGS. 2 and 3) at a later point in time, wherein the individual component 17 is connected to a further individual component 17 to form the washbasin 2 (FIG. 3). The second functional unit 4 is undetachably arranged in the washbasin 2 by the connection of the individual components 17 and is in that way also inseparably connected to the washbasin 2.

Figure 6:
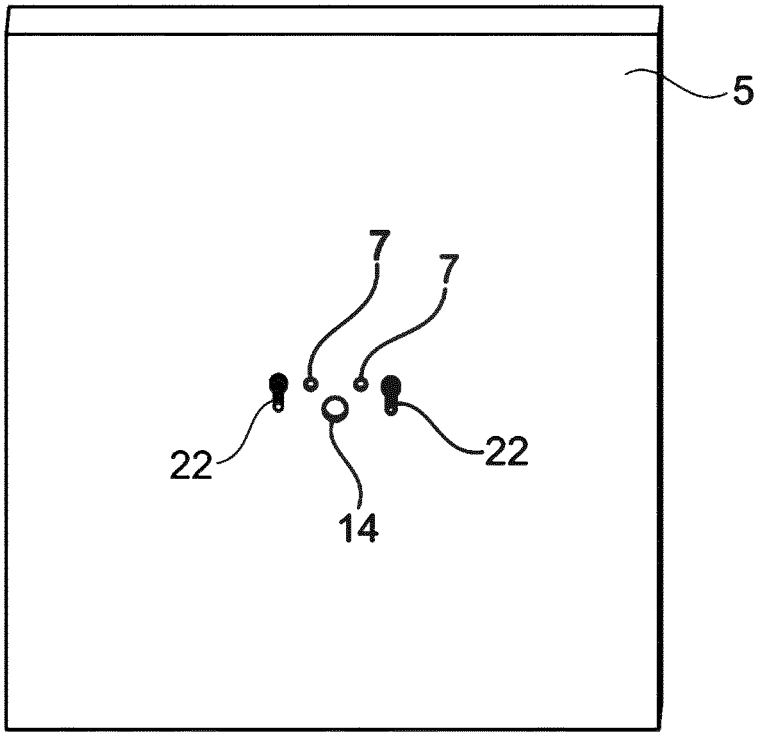
FIG. 6 shows a perspective view of the wall element.
Figure 7:
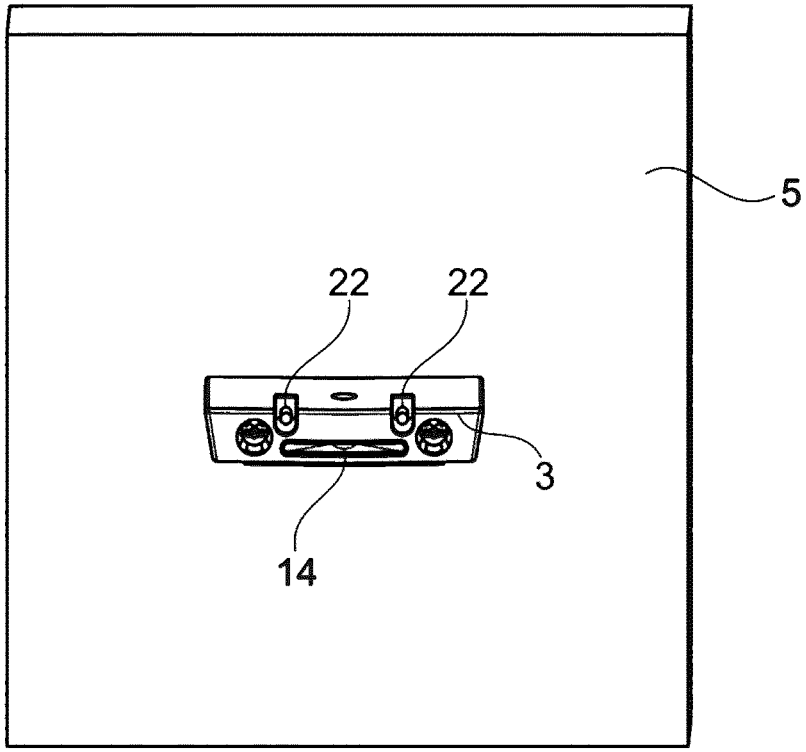
FIG. 7 shows a perspective view of the wall element according to FIG. 6 with a first functional unit.
Figure 8:
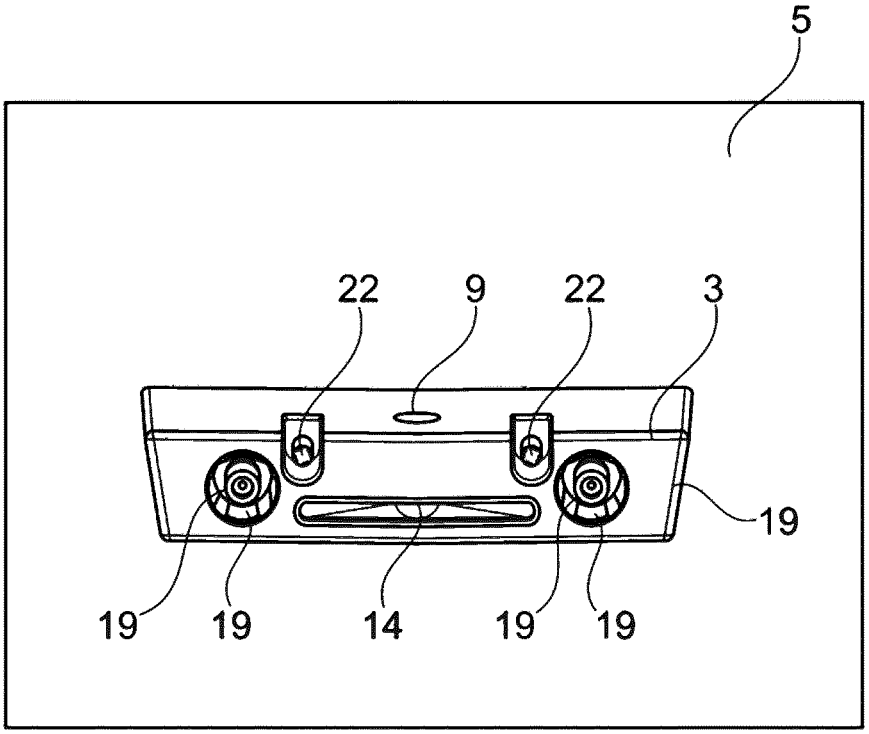
FIG. 8 shows a perspective view a detail of FIG. 7.
Figure 9:
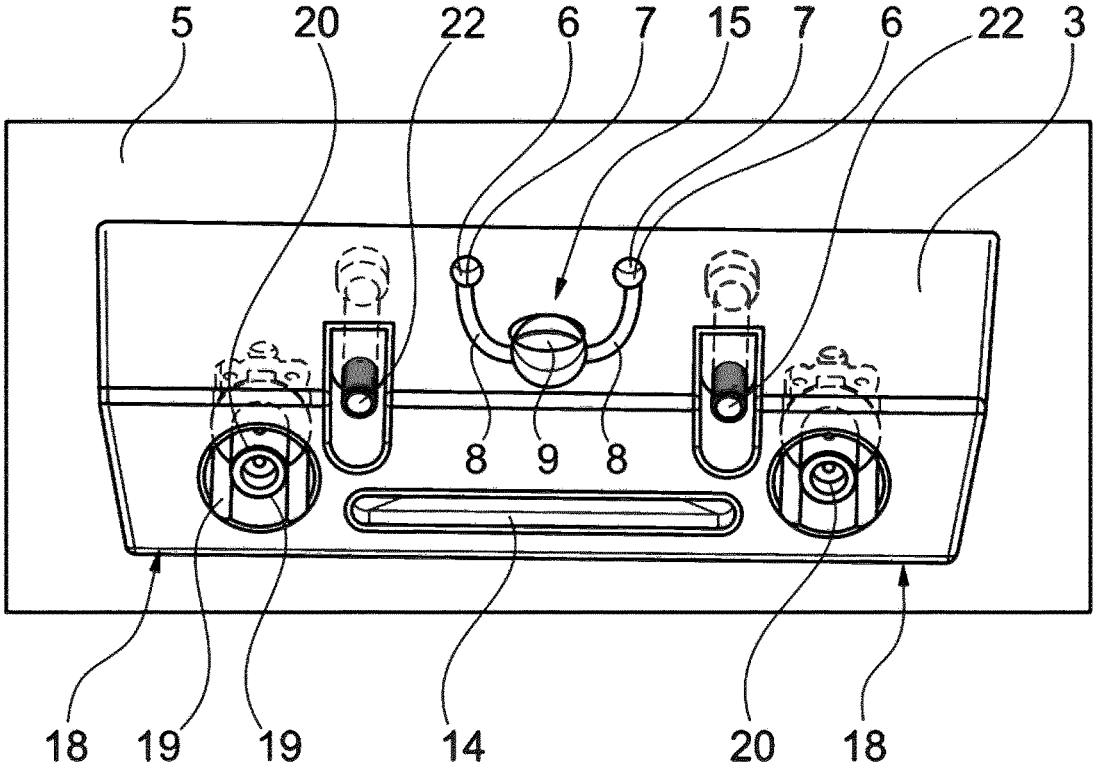
FIG. 9 shows a perspective and partially transparent view of the first functional unit according to FIGS. 7 and 8.

FIG. 6 shows a perspective view of the wall element 5. FIG. 7 shows a perspective view of the wall element 5 of FIG. 6 having a first functional unit 3. FIG. 8 shows a perspective view of a detail of FIG. 7. FIG. 9 shows a perspective and partially transparent view of the first functional unit 3 of FIGS. 7 and 8. FIGS. 6 and 9 are described jointly below. Reference is made to the explanations of FIGS. 1 to 5.

The washbasin installation arrangement 1 comprises a washbasin 2, a first functional unit 3, and a second functional unit 4. The first functional unit 3 is arranged on a wall element 5 and has a first port 6 for the fluidic connection to a supply line 7 for a fluid (e.g., water), a first line 8 extending through the first functional unit 3, and a first connecting element 9 that is fluidically connected to the first port 6 via the first line 8.

The functional units 3, 4 all have first lines 8 and second lines 12 connecting the supply line 7 to the faucet 11. The first line 8 is designed to be integrated in the first functional unit 3 and the second line 12 is designed to be integrated in the second functional unit 4.

The washbasin 2 is connected to the first functional unit 3 solely via the second functional unit 4.

The second functional unit 4 and the first functional unit 3 form a drain 14 for a fluid from the washbasin 2. The drain 14 is also a line that extends from an outlet on the washbasin through the functional units 3, 4 to a port on the wall element 5.

A siphon assigned to the drain 14 is integrated in the first functional unit 3 or the second functional unit 4.

A safety valve 15 for closing and opening the first line 8 is arranged in the first line 8, which can be or is actuated by disconnecting the functional units 3, 4 for closing the first line 8 and by connecting the functional units 3, 4 for opening the first line 8. The safety valve 15 is arranged in the first functional unit 3, i.e., between the first port 6 and the first connecting element 9.

The safety valve 15 allows the functional units 3, 4 to be separated from each other and thus the washbasin 2 to be separated from the supply line 7 without any fluid escaping.

The first functional unit 3 is slid onto pins 22 of the wall element 5 and connected thereto. A connection to the supply line 7 can be established via a plug connection.

The second functional unit 4 is pushed onto the first functional unit 3 along an axial direction 23 (see FIG. 1). In so doing, guides 19 are provided on the first functional unit 3 (see FIGS. 8 and 9) and on the second functional unit 4 (see FIG. 5), which guides interact to arrange the functional units 3, 4. The first functional unit 3 has first coupling elements 20 (FIGS. 8 and 9), which are arranged in the first functional unit 3. The second functional unit 4 has second coupling elements 21 (FIG. 5) interacting with the first coupling elements 20 to connect the functional units 3, 4. The first coupling elements 20 can be actuated by an actuating device 18 (see FIG. 9), arranged at the second functional unit 4, or by a pull-off force, such that the connection between the first coupling element 20 and the second coupling element 21 is released and the second functional unit 4 and the washbasin can be pulled off the first functional unit 3.

In the method, in step a) a wall element 5 and a supply line 7 are provided (see FIG. 6), in step b) a first functional unit 3 is provided, and in step c) the first functional unit 3 is connected to the wall element 5 and the supply line 7 is connected to a first port 6 of the first functional unit 3 (see FIGS. 7 to 9). During step d), a washbasin 2 having a second functional unit 4 connected thereto (see FIGS. 2 to 5) is provided, and during step e), the second functional unit 4 is slid onto the first functional unit 3 (see FIG. 1).

In this case, any sliding is performed exclusively along an axial direction 23, wherein all fluidic and possibly electrical connections are formed between the functional units 3, 4.

LIST OF REFERENCE NUMERALS

1 washbasin installation arrangement
2 washbasin
3 first functional unit
4 second functional unit
5 wall element

6 first port
7 supply line
8 first line
9 first connecting element
10 second port
11 faucet
12 second line
13 second connecting element
14 drain
15 safety valve
16 connection
17 individual component
18 actuating device
19 guide
20 first coupling element
21 second coupling element
22 pin
23 axial direction

The invention claimed is:

1. A washbasin installation arrangement (1), comprising a washbasin (2), a first functional unit (3), a second functional unit (4), and a wall element (5) having a front surface, wherein the first functional unit (3) is attachable to the wall element (5), and the first functional unit (3) comprises at least one first port (6) for a fluidic connection to at least one supply line (7) for a fluid, a first line (8) extending through the first functional unit (3), and a first connecting element (9) fluidically connected to the first port (6) via the first line (8);

wherein the second functional unit (4) is connected to the washbasin (2), wherein the second functional unit (4) comprises at least one second port (10) for a faucet (11), a second line (12) extending through the second functional unit (4), and a second connecting element (13) fluidically connected to the second port (10) via the second line (12);

wherein the washbasin (2) connected to the second functional unit (4) can be pushed onto the first functional unit (3) attached to the wall element (5), wherein the first connecting element (9) and the second connecting element (13) are connected by a sliding to establish a fluidic connection of the second port (10) and the supply line (7); and wherein the second functional unit (4) connected to the washbasin (2) completely surrounds the first functional until (3) on each exposed surface protruding away from the wall element (5) when the first functional unit (3) is installed on the front surface of the wall element (5).

2. The washbasin installation arrangement (1) according to claim 1, wherein the second functional unit (4) is detachably or inseparably connected to the washbasin (2).

3. The washbasin installation arrangement (1) according to claim 1, wherein the washbasin (2) is connected to the first functional unit (3) only through the second functional unit (4).

4. The washbasin installation arrangement (1) according to claim 1, further comprising a drain (14) from the washbasin (2), wherein the drain (14) is formed from the second functional unit (4) and the first functional unit (3).

5. The washbasin installation arrangement (1) according to claim 4, wherein the first functional unit (3) or the second functional unit (4) is configured to have a siphon assigned to the drain (14) integrated therein.

6. The washbasin installation arrangement (1) according to claim 1, wherein at least one of the first line (8) and the second line (12) comprises a safety valve (15) for closing and opening the first line (8) and/or the second line (12), wherein the safety valve is actuated by disconnecting the first functional unit (3) and the second functional unit (4) to close the first line (8) and the second line (12), and by connecting the first functional unit (3) and the second functional unit (4) to open the first line (8) and the second line (12).

7. The washbasin installation arrangement (1) according to claim 1, wherein at least one of the first functional unit (3) and the second functional unit (4) is an injection molded plastic part.

8. The washbasin installation arrangement (1) according to claim 1, wherein the first functional unit (3) and the second functional unit (4) each further comprise an electrical signal line that is interconnected in an electrically conductive manner by sliding the second functional unit (4) onto the first functional unit (3).

9. A method of assembling the washbasin installation arrangement (1) according to claim 1, comprising:

a) providing a wall element (5) having a front surface and at least one supply line (7);

b) providing a first functional unit (3) comprising a first port (6);

c) connecting the first functional unit (3) to the wall element (5) and connecting the supply line (7) to the first port (6) of the first functional unit (3);

d) providing a washbasin (2) comprising a second functional unit (4) assigned thereto; and e) sliding the second functional unit (4) onto the first functional unit (3).

* * * * *